US005613901A

United States Patent [19]

Weber et al.

[11] Patent Number: 5,613,901

[45] Date of Patent: Mar. 25, 1997

[54] APPARATUS FOR PRESSING A CIRCULATING GRINDING BELT

[76] Inventors: Georg Weber, Friesener Strasse 27; Martin Ellmer, Seelach 67, both of 96317 Kronach, Germany

[21] Appl. No.: 552,267

[22] Filed: Nov. 2, 1995

[30] Foreign Application Priority Data

Aug. 30, 1995 [DE] Germany ..... 295 13 946.3

[51] Int. Cl.[6] ..... B24B 21/08

[52] U.S. Cl. ..... 451/303

[58] Field of Search ..... 451/303, 168, 451/24

[56] References Cited

U.S. PATENT DOCUMENTS

| | | | |
|---|---|---|---|
| 818,518 | 4/1906 | Clemons | 451/303 |
| 3,911,627 | 10/1975 | Heesemann | 451/303 |
| 4,527,359 | 7/1985 | Stump et al. | 451/303 |

FOREIGN PATENT DOCUMENTS

| | | | |
|---|---|---|---|
| 3503088 | 7/1986 | Germany | 451/303 |
| 4116746 | 2/1992 | Germany . | |

*Primary Examiner*—Robert A. Rose

*Attorney, Agent, or Firm*—McCormick, Paulding & Huber

[57] ABSTRACT

In an apparatus for pressing the grinding belt of a belt grinding machine to the upper surface of a workpiece, a pressing beam located above and extending transversely to the feed direction of the workpiece carries a row of positioning units having downwardly extending positioning rods for applying forces to an equalizing mat positioned between the lower ends of the rods and the inner side of the grinding belt to push the belt downwardly onto the top surface of the workpiece. The forces are transferred from the positioning rods to the equalizing mat by a row of pressure plates respectively associated with the positioning rods with the lower ends of the positioning rods lying loosely against the pressure plates. This achieves a simplified construction easing maintenance and repair and allows the equalizing pad to have the ability to uniformly distribute the forces onto the grinding belt and to have the flexibility needed to accommodate workpiece top surfaces of different shapes.

14 Claims, 2 Drawing Sheets

APPARATUS FOR PRESSING A CIRCULATING GRINDING BELT

FIELD OF THE INVENTION

The invention concerns an apparatus for pressing a circulating grinding belt of a belt grinding machine onto the upper surface of a workpiece, with a pressing beam with a plurality of controllable positioning units, which are arranged in a plane parallel to the work surface of the grinding belt, the positioning units having positioning rods actuatable in the direction perpendicular to the work surface of the grinding belt, which positioning rods exert predetermined forces onto pressure plates which forces are areally transferred through the pressure plates to an elastic equalizing mat consisting of one or more layers, which equalizing mat is arranged to overlie the inner side of the grinding belt.

BACKGROUND OF THE INVENTION

An apparatus of the above-mentioned kind is known from German patent DE 35 03 088 C2 owned by the assignee of this application. The apparatus described therein uses positioning units whose piston rods are provided with U-shaped pressure pieces. For the transfer of pressure force, the shank of each pressure piece lies on a box-shaped pressure plate which distributes the force areally and transfers it to an equalizing mat. Each box-shaped pressure plate is so supported in a carrier of the pressing beam that it can be inclined in different directions, yet is secured with respect to rotation about a vertical axis perpendicular to the work plane of the grinding belt. Moreover the support of the box-shaped pressure plates permits a lifting and lowering of them together with the piston rods. Although the known apparatus operates satisfactorily, it has nevertheless various disadvantages. For example, the support of the box-shaped pressure plates is technically expensive. Also the assembly of the pressing beam with the plurality of controllable positioning units is complicated. Likewise the maintenance or possible disassembly of the pressing beam for repair purposes is technically expensive.

From DE-OS 26 34 829 a pressing beam for an endless circulating grinding belt of a belt-grinding machine whose equalizing mat is held by a C-shaped bracket is known. Arranged inside of this bracket is a pillow-shaped body which can be acted upon by pressurized air and which is available to press the equalizing mat to the grinding belt with the required pressing force.

SUMMARY OF THE INVENTION

The object of the invention is to provide an apparatus for pressing a circulating grinding belt which apparatus is of simple construction and by means of which increased functional efficiencies can be realized at small practical expense.

This object is solved for a known apparatus in that the pressure plates are arranged on the upper surface of the equalizing mat facing the positioning rods and are bonded to that surface.

In accordance with the invention, the pressure plates form a mechanical connection with the equalizing mat whereby it is possible for the ends of the positioning rods of the adjusting units to solely lie loosely on the pressure plates to transmit the pressing forces. A mechanical coupling between the positioning rods and the pressure plates can, therefore, be omitted. Thereby the construction of the apparatus is simplified without influencing its functions. By the mechanical uncoupling of the pressing beam and the equalizing mat, the entire apparatus can be easily assembled in a belt grinding machine; and likewise maintenance and repair can be eased.

Pneumatically operating cylinders can be used as the positioning units the piston rod ends of which work directly on the pressure plates. Obviously positioning units can also be used which work on hydraulic and electrical principles such as, for example, moving coil driven positioning units.

Each pressure plate is made of rigid material, preferably of light aluminum sheet, and has the purpose of converting the generally pointwise transmitted force from the positioning rod areally onto the associated section of the elastic equalizing mat.

A preferred exemplary embodiment provides that the pressure plates are adhesively bonded with the equalizing mat, preferably by means of a double adhesive band. The adhesive bonding of the pressure plates assures that the pressure plates remain in place in case of a force direction departing from the perpendicular direction in the application of the pressing forces. Thus the equalizing mat can elastically conform itself to the definite shape of the workpiece upper surface so that a uniform pressure in the associated sections of the equalizing mat, which lie opposite to the pressure plates is assured. By the use of a double adhesive band, a simple constructive solution is obtained.

It is further advantageous if the equalizing mat has a felt layer on its side facing the pressure plates, to which felt layer the pressure plates are bonded. This felt layer inhibits a pimpling of the associated pressure plates at the places at which the force is applied and which pimpling becomes noticeable on the side of the equalizing mat facing the grinding belt. The felt layer, therefore, increases the uniformness of the force transference.

A further development provides that the pressure plates are arranged at predetermined side-by-side spacings along a row on the equalizing mat. Because of this spacing, the elastic equalizing mat can realize bending lines with small radii in the intermediate areas between pairs of pressure plates, so that workpiece upper surfaces with highly different shapes can be worked with good grinding results.

BRIEF DESCRIPTION OF THE DRAWINGS

An exemplary embodiment of the invention is described in the following in conjunction with the drawings. The drawings are.

DESCRIPTION OF THE PREFERRED EMBODIMENT

Figure 1:
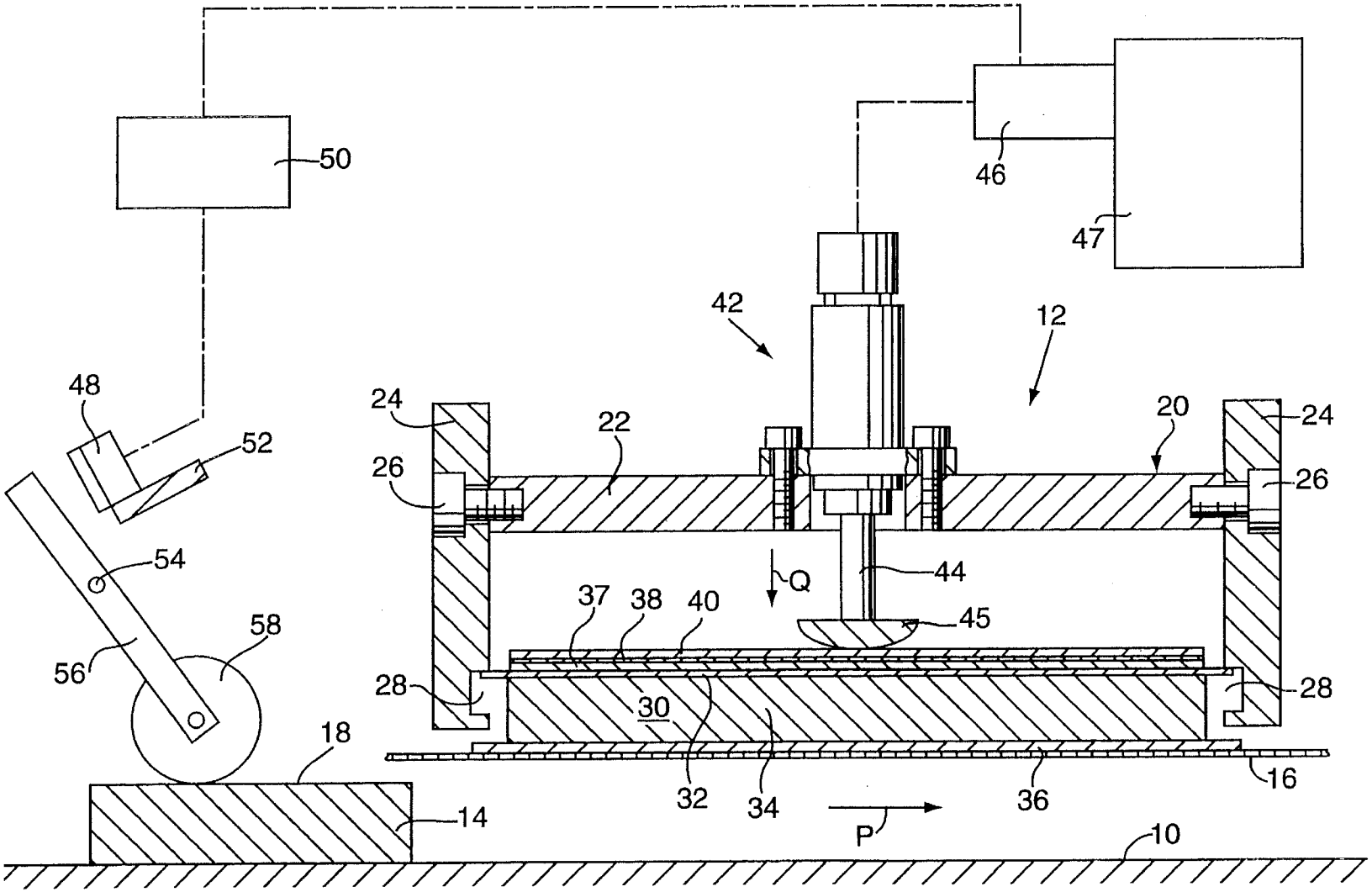
FIG. 1 a partially schematic cross-section through an apparatus according to the invention and having a pressing beam, and FIG. 2 a cross-section through an equalizing mat with adhesively applied pressure plates.

In FIG. 1, a pressing beam, indicated generally at 12, is arranged above a workpiece support table 10 of a belt grinding machine, by means of which pressing beam the circulating endless grinding belt 16 is pressed against the upper surface 18 of the workpiece 14 perpendicular to the workpiece feed direction P. The belt grinding machine can, in itself, be a conventional belt grinding machine which is, therefore, not illustrated and explained in more detail.

The pressing beam 12 has a carrier, indicated generally at 20, with a traverse 22 on each of the longitudinal edges of which a closure bar 24 is fastened by screws 26. On the inner side of each closure bar 22 is a groove 28 near the lower longitudinal edge of the bar and running parallel to the edge, in which groove and elastic equalizing mat, indicated generally at 30, is held, which mat extends over the entire length of the pressing beam 12. The equalizing mat 30 consists of several layers and includes a steel band 32 of spring steel, also referred to as spring lamina. The steel band 32 on its lower side is adhesively bonded to a felt mat 34, which in turn on its lower side is provided with a glide layer 36, which for example can be glued to the felt mat 34. A felt layer 38 is glued to the upper side of the steel band 32. This felt layer 37 carries pressure plates 40 which are connected with the felt layer 37 by a doubly adhesive band 38.

The equalizing mat 30 is so fastened at the edges of the steel band 32 to the carrier 20 that it is fixed in the direction of belt movement and yet is adjustable in height within the grooves 28. The equalizing mat 30 is held by the grinding belt 16 in the upper position illustrated in FIG. 1 because of the tensioning of the grinding belt, in which position it lies at the upper edges of the grooves.

A plurality of positioning units 42, arranged behind one another in the viewing direction of FIG. 1 above the equalizing mat 30, serve to press the elastic equalizing mat 30 and the grinding belt 16 to the upper surface of the workpiece 14. The positioning units 42 have positioning rods 44 which can be lowered in the direction of the arrow Q toward the workpiece 14. Lifting of the positioning rods 44 in the direction opposite to the arrow Q takes place by means of spring force, for example, by a return spring arranged in the positioning unit 42. The positioning units 42 are provided as commercially available pneumatic cylinders which are screw connected to the upper side of the traverse 22 behind one another in the viewing direction of FIG. 1 and which can be actuated with pressurized air from a pressurized air line or from a pressurized air tank, indicated schematically at 47, through a valve 46. The valve 46 is in turn operated by a proximity switch 48 through an electronic switching arrangement 50. The proximity switch 48, arranged on a bar 52 fastened to a machine frame, is actuated by a sensing organ consisting of a lever 56 pivotal about an axis 54 and a sensing roll rotatably supported at the lower end of the lever 56. If a workpiece 14 moves into the belt grinding machine in the direction of the arrow P, the sensing organ is pivoted about the pivot axis 54, which is parallel to the longitudinal direction of the pressing beam 12, and thereby actuates the associated proximity switch 48. The electronic switching arrangement 50 so functions that the valve 46 is operated with a given delay which guarantees that the grinding belt 16 is first lowered toward the workpiece 14 by means of the positioning units 42 when the workpiece has moved under the grinding belt 16.

Each positioning rod 44 carries at its end directed toward the grinding belt 16 a cap nut 45 which, for example, is connected with the positioning rod 44 by means of a screw (not illustrated). The cap nut 45 has a partially ball shaped outer surface which assures that the force exerted by the positioning unit 42 onto the pressure plate 40 is introduced nearly pointwise, and the pressure plate 40 with the application of force can be deflected in various directions. The cap nut 45 lies loosely on the pressure plate 40. When the positioning unit 42 is not supplied with pressurized air, the positioning rod 44 lifts the cap nut 45 from the pressure plate 40 through the effect of the return spring in the positioning unit 42.

Upon the pressing of the cap nut 45 against the pressure plate 40, the associated section of the equalizing mat 30 is moved toward the workpiece top surface 18. Because of the flexibility of the pressure plate 40, as a result of its pointwise contact with the cap nut 45, the pressure plate can suit the grinding belt 60 in the associated section to possible waviness in the top surface 18 of the workpiece 14. This ensures that in the case of either longitudinal or transverse waviness of the upper surface 18 the upper surface 18 the associated section can be ground with a uniform high stock removal, without the danger existing that the wave crests will be more heavily ground than the valleys lying between the crests. Since the positioning units 42 are individually controllable, a definite stock removal of uniform amount over the entire upper surface 18 of the workpiece can be achieved. Because of the support of the equalizing mat in the grooves 28 with play, it cannot be turned about an axis parallel to the arrow Q. The equalizing mat 30 is thereby held stable in its work position and can elastically follow the shape of the upper surface 18 of the workpiece 14.

Figure 2:
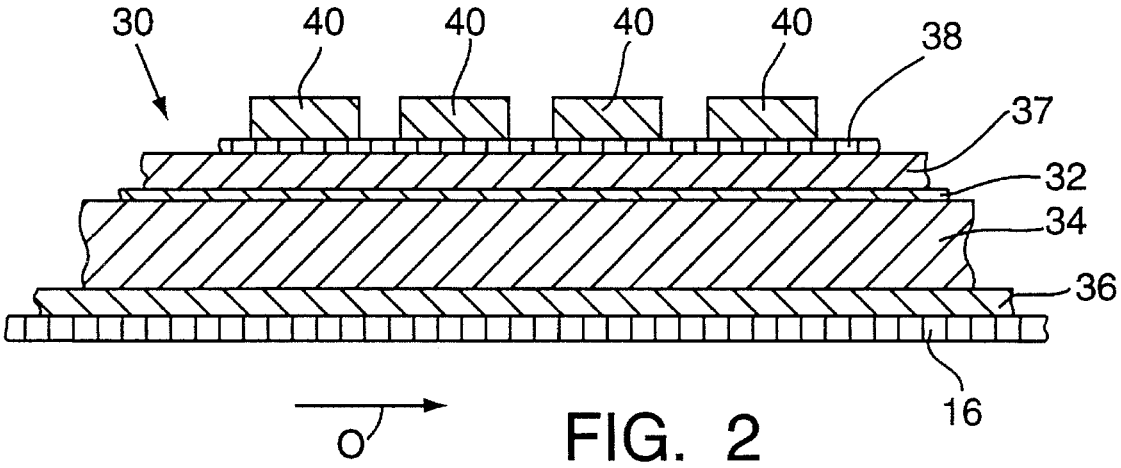

FIG. 2 shows in a longitudinal section the construction of the equalizing mat 30, the glide layer 36 of which slidingly lies on the inner side of the grinding belt 16. In FIG. 2 it is to be seen that the rectangularly-shaped pressure plates 40 are arranged with predetermined spacing between their opposite sides along a row on the felt layer 37 and are adhesively bonded to the felt layer by a double adhesive band 38. This spacing ensures that the equalizing mat can bend in the direction perpendicular to the arrow O and that the grinding belt 16 can conform to the upper surface 18 of the workpiece 14 along a bending line running essentially along the arrow O with uniform pressure. For a raster measurement of 32 mm in the direction of the arrow O, the corresponding measurement of the pressure plates 40 is about 30 mm.

We claim:

1. An apparatus for pressing a circulating grinding belt (16) of a belt grinding machine to the upper surface of a workpiece, with a pressing beam (12) with a plurality of controllable positioning units (42) arranged in a plane parallel to the working surface of the grinding belt (16), with the positioning units (42) having positioning rods (44) operable in the direction (Q) perpendicular to the working surface of the grinding belt (16), which positioning rods exert predetermined forces onto pressure plates (40), which forces are areally transferred by the pressure plates (40) to an elastic equalizing mat (30) consisting of several layers (32, 34, 36, 37, 38), which equalizing mat has an upper surface and is arranged to lie opposite to the inner side of the grinding belt (16), said layers of said mat including an upper layer (32) consisting of a band of spring material, characterized in that the pressure plates (40) are arranged on the upper surface of the equalizing mat (30) above said band of spring material and are fixed relative to said band of spring material, and in that each of said positioning rods has a downwardly facing lower end surface which lower end surface when said rod is moved downwardly in said direction (Q) comes into engagement with the associated one of said pressure plates to exert a force onto said pressure plate and which end surface when said rod is moved upwardly in the direction opposite to the direction (Q) moves out of contact with said associated one of said pressure plates.

2. An apparatus according to claim 1 further characterized in that for the transference of force to the associated pressure plate (40) said downwardly facing end surface of each positioning rod (44) is rounded so as to have a nearly pointwise contact with the pressure plate (40).

3. An apparatus according to claim 2 further characterized in that said downwardly facing lower end surface of each positioning rod (44) is provided by a cap nut (45) for a nearly pointwise engagement with the pressure plate (40) at approximately the middle point of the pressure plate.

4. An apparatus according to claim 1 further characterized in that the pressure plates (40) are of rectangular shape and are arranged at predetermined side-by-side spacings along a row on the equalizing mat (30).

5. An apparatus according to claim 1 further characterized in that the pressure plates (40) are adhesively bonded to the equalizing mat (30).

6. An apparatus according to claim 1 characterized in that the pressure plates (40) are made of aluminum.

7. An apparatus according to claim 1 further characterized in that the pressure plates have a raster measurement along the length of the pressure beam (12) of approximately 32 mm and a spacing from one another of approximately 30 mm.

8. An apparatus according to claim 1 characterized in that the equalizing mat (30) has a felt layer (38) located above said band of spring material to which felt layer (37) said pressure plates (40) are bonded.

9. An apparatus for pressing a circulating grinding belt (16) of a belt grinding machine to the upper surface of a workpiece, with a pressing beam (12) with a plurality of controllable positioning units (42) arranged in a plane parallel to the working surface of the grinding belt (16), with the positioning units (42) having positioning rods (44) operable in the direction (Q) perpendicular to the working surface of the grinding belt (16), which positioning rods exert predetermined forces onto pressure plates (40), which forces are really transferred by the pressure plates (40) to an elastic equalizing mat (30) consisting of several layers (32, 34, 36, 37, 38), which equalizing mat is arranged to lie opposite to the inner side of the grinding belt (16), characterized in that the pressure plates (40) are arranged on the upper surface of the equalizing mat (30) facing the positioning rods and are bonded to said upper surface of equalizing mat, that the equalizing mat (30) has a felt layer (38) on its side facing the pressure plates (40) to which felt layer (37) the pressure plates (40) are bonded, and in that the equalizing mat (30) contains a steel band (32), which steel band is bonded with the felt layer (37) and with a felt mat (34) facing the grinding belt (16).

10. An apparatus according to claim 9 further characterized in that the felt mat (34) carries a glide layer (36) on its side facing the grinding belt (16).

11. An apparatus according to claim 1 further characterized in that said steel band (32) of said mat (30) is guided with play at its longitudinal edges in grooves (28) located on both sides of said steel bank and formed in a carrier (20) of the pressing beam (12).

12. An apparatus according to claim 5 further characterized by said pressure plates (40) being adhesively bonded to said equalizing mat (30) by means of a double adhesive band (38).

13. An apparatus according to claim 6 further characterized in said pressure plates (40) having a thickness of approximately 3 mm.

14. An apparatus according to claim 9 further characterized in that said steel band (32) is made of spring steel.

* * * * *